US011396741B2

(12) United States Patent
Zhou et al.

(10) Patent No.: US 11,396,741 B2
(45) Date of Patent: Jul. 26, 2022

(54) MULTIFUNCTION FAUCET

(71) Applicant: Shanghai Kohler Electronics Ltd., Shanghai (CN)

(72) Inventors: Xiaojun Zhou, Shanghai (CN); Qiang Xiao, Shanghai (CN); Feiying Su, Shanghai (CN); Weiren Lin, Shanghai (CN)

(73) Assignee: SHANGHAI KOHLER ELECTRONICS LTD., Shanghai (CN)

( * ) Notice: Subject to any disclaimer, the term of this patent is extended or adjusted under 35 U.S.C. 154(b) by 0 days.

(21) Appl. No.: 17/161,045

(22) Filed: Jan. 28, 2021

(65) Prior Publication Data

US 2021/0148102 A1 May 20, 2021

Related U.S. Application Data

(63) Continuation of application No. 16/356,112, filed on Mar. 18, 2019, now Pat. No. 10,907,330.

(30) Foreign Application Priority Data

Mar. 28, 2018 (CN) ..... 201810270521.7

(51) Int. Cl.
*E03C 1/046* (2006.01)

(52) U.S. Cl.
CPC ..... *E03C 1/0465* (2013.01)

(58) Field of Classification Search
CPC ..... E03C 1/0465; E03C 1/046; E03C 1/057; E03C 1/055
USPC ..... 4/668
See application file for complete search history.

(56) References Cited

U.S. PATENT DOCUMENTS

| | | | | |
|---|---|---|---|---|
| 10,087,608 | B2 | 10/2018 | Dobizl et al. | |
| 10,428,498 | B1 | 10/2019 | Montague | |
| 2013/0291947 | A1* | 11/2013 | Chandler | E03C 1/057 4/678 |
| 2015/0033469 | A1 | 2/2015 | Ferrante | |
| 2016/0024766 | A1* | 1/2016 | Sawaski | G01D 5/2405 4/668 |
| 2016/0069052 | A1 | 3/2016 | Burgo et al. | |
| 2016/0069054 | A1* | 3/2016 | Yu | E03C 1/046 4/638 |
| 2017/0107704 | A1 | 4/2017 | Wang et al. | |
| 2017/0328047 | A1 | 11/2017 | Murata et al. | |
| 2019/0001006 | A1* | 1/2019 | Rodenbeck | A61L 2/18 |

* cited by examiner

*Primary Examiner* — Huyen D Le
(74) *Attorney, Agent, or Firm* — Foley & Lardner LLP

(57) ABSTRACT

A faucet that includes a housing with a water supply assembly, a soap supply assembly, first and second sensing probe assemblies, and a controller provided in the housing, wherein a sensing region of the first sensing probe assembly is an upper portion of the housing, a sensing region of the second sensing probe assembly is a lower portion of the housing, an output terminal of each sensing probe assembly is electrically connected with an input terminal of the controller, and an output terminal of the controller is electrically connected with a control terminal of each of the water and soap supply assemblies. The controller controls the water supply assembly to start/stop water supply according to the sensing signal from the first or second sensing probe assembly, and controls the soap supply assembly to start/stop soap supply according to the sensing signal from the first or second sensing probe assembly.

20 Claims, 6 Drawing Sheets

MULTIFUNCTION FAUCET

CROSS-REFERENCE TO RELATED PATENT APPLICATIONS

The present application is a continuation of U.S. patent application Ser. No. 16/356,112 (now U.S. Pat. No. 10,907,330), filed Mar. 18, 2019, which claims the benefit of and priority to Chinese Patent Application No. 201810270521.7, filed Mar. 28, 2018 (now Chinese Patent No. ZL201810270521.7), both of which are incorporated herein by reference in their entireties.

BACKGROUND

The present disclosure relates to the field of kitchen and bath products and related technologies. More specifically, the present disclosure relates to a multifunctional faucet and a control method thereof.

At present, faucets are divided into mechanical faucets and electronic faucets. A conventional electronic faucet supplies water automatically, i.e., supplying water when a user is sensed within a sensing distance, and only has on/off functions, leading to a limited capability.

Therefore, according to reference documents CN105042153A and CN105757311A, it has been proposed that gestures may be used to control the flow rate, water temperature, sterilization, and the like of the water from a faucet. Meanwhile, when a user uses water from a faucet for cleaning, a hand soap is typically used. According to the reference document CN202484351U, it has been proposed that the soap supply function may be added to a faucet to develop a multifunctional faucet.

However, existing multifunctional faucets and corresponding gesture control methods thereof require complicated operations and do not achieve desired effects.

SUMMARY

In view of the technical problem of multifunctional faucets in which the operations are complicated and the effects are not desirable, there is a need to provide a multifunctional faucet and a control method thereof.

The present disclosure provides a multifunctional faucet that includes a faucet housing, with a water supply assembly, a soap supply assembly, a first sensing probe assembly, a second sensing probe assembly, and a controller provided in the faucet housing, wherein the sensing region of the first sensing probe assembly is an upper portion of the faucet housing, the sensing region of the second sensing probe assembly is a lower portion of the faucet housing, an output terminal of the first sensing probe assembly and an output terminal of the second sensing probe assembly are respectively in communicative connection with an input terminal of the controller, an output terminal of the controller is in communicative connection with a control terminal of the water supply assembly and a control terminal of the soap supply assembly, the controller controls the water supply assembly to start water supply or stop water supply according to a sensing signal from the first sensing probe assembly or the second sensing probe assembly, and the controller controls the soap supply assembly to start soap supply or stop soap supply according to a sensing signal from the first sensing probe assembly or the second sensing probe assembly.

The multifunctional faucet can include a third sensing probe assembly disposed in the faucet housing, wherein the sensing region of the third sensing probe assembly is the front of the faucet housing, an output terminal of the third sensing probe assembly is in communicative connection with a trigger terminal of the controller, and the controller is triggered and activated when the third sensing probe assembly detects a sensing signal.

The multifunctional faucet can include an electrolyte assembly disposed in the faucet housing, wherein the output terminal of the controller is in communicative connection with the electrolyte assembly, and the controller controls the electrolyte assembly to start electrolyte supply or stop electrolyte supply.

The faucet housing can include a base and a cover assembly in coordination with the base, where the base and the cover assembly form an accommodating chamber. The water supply assembly, the soap supply assembly, and the second sensing probe assembly are accommodated in the accommodating chamber, the first sensing probe assembly is accommodated in the cover assembly, a water supply indicator, a wait-for-soap indicator, and a soap supply indicator are further provided in the cover assembly. The output terminal of the controller is in communicative connection with the water supply indicator, the wait-for-soap indicator, and the soap supply indicator.

The present disclosure provides a control method for the above-described multifunctional faucet that includes the following steps or processes.

When the controller is in a wake state, if a sensing signal is received from the second sensing probe assembly, the controller enters a water supply state to control the water supply assembly to start water supply; if a sensing signal is received from the first sensing probe assembly, the controller enters a soap supply state to control the soap supply assembly to start soap supply within a preset soap supply period and control the soap supply assembly to stop soap supply after the preset soap supply period;

When the controller is in the water supply state, if a sensing signal is received from the first sensing probe assembly, the controller enters the soap supply state to control the soap supply assembly to start soap supply within a preset soap supply period and control the soap supply assembly to stop soap supply after the preset soap supply period; when the controller is in the water supply state, if no sensing signal is received from the first sensing probe assembly and no sensing signal is received from the second sensing probe assembly, the controller enters the wake state;

When the controller is in the soap supply state, and after the preset soap supply period, if a sensing signal is received from the second sensing probe assembly, the controller enters the water supply state to control the water supply assembly to start water supply, and if no sensing signal is received from the second sensing probe assembly, the controller enters the wake state to control the water supply assembly to stop water supply.

The method can further include the step of: if a sensing signal is received from the first sensing probe assembly, the controller entering the soap supply state specifically includes the following two conditions.

First, if a sensing signal is received from the first sensing probe assembly, the controller enters a switch-to-soap state.

Second, when the controller is in the switch-to-soap state, if a sensing signal is continuously received from the first sensing probe assembly within a preset confirmation period, the controller enters the soap supply state, and if no sensing signal is continuously received from the first sensing probe assembly within the preset confirmation period, the controller enters the wake state.

Furthermore, the faucet housing can include a base and a cover assembly in coordination with the base, the base and the cover assembly form an accommodating chamber, the water supply assembly, the soap supply assembly, and the second sensing probe assembly are accommodated in the accommodating chamber, the first sensing probe assembly is accommodated in the cover assembly, a water supply indicator, a hand-waving prompt indicator, a wait-for-soap indicator, and a soap supply indicator are further provided in the cover assembly, and the output terminal of the controller is in communicative connection with the water supply indicator, the hand-waving prompt indicator, the wait-for-soap indicator, and the soap supply indicator;

the step of, when the controller is in the water supply state, if no sensing signal is received from the first sensing probe assembly and no sensing signal is received from the second sensing probe assembly, the controller entering the wake state specifically comprises:

when the controller is in the water supply state, if no sensing signal is received from the first sensing probe assembly and no sensing signal is received from the second sensing probe assembly, the controller enters a return-to-wake state and controls the wait-for-soap indicator to display a preset prompt effect, and if the controller is in the return-to-wake state, no sensing signal is received from the first sensing probe assembly and no sensing signal is received from the second sensing probe assembly continuously within a preset return period, the controller enters the wake state; the control method further comprises: when the controller is in the water supply state, controlling the water supply indicator to display a preset water supplying animation effect; when the controller is in the switch-to-soap state, controlling the wait-for-soap indicator to display a preset soap switching animation effect; and when the controller is in the soap supply state, controlling the soap supply indicator to display a preset soap supplying animation effect.

The multifunctional faucet can include a third sensing probe assembly disposed in the faucet housing, wherein the sensing region of the third sensing probe assembly is the front of the faucet housing, an output terminal of the third sensing probe assembly is in communicative connection with a trigger terminal of the controller, and the control method further comprises: triggering the controller to enter the wake state when the third sensing probe assembly detects a sensing signal; and when the controller is in the wake state, if no sensing signal is received from the first sensing probe assembly and no sensing signal is received from the second sensing probe assembly within a preset standby detection period, the controller enters a standby state.

The multifunctional faucet can include an electrolyte assembly disposed in the faucet housing, wherein the output terminal of the controller is in communicative connection with the electrolyte assembly, the controller controls the electrolyte assembly to start electrolyte supply or stop electrolyte supply, and the control method further comprises: controlling the electrolyte assembly to start electrolyte supply after every preset cleaning interval, and controlling the electrolyte assembly to stop electrolyte supply after a preset electrolyte supply period.

Furthermore, the step of controlling the electrolyte assembly to start electrolyte supply after every preset cleaning interval specifically comprises: after every preset cleaning interval, if the controller is in the standby state, controlling the electrolyte assembly to start electrolyte supply, and if the controller is in a state other than the standby state, controlling the electrolyte assembly to suspend electrolyte supply.

The present invention senses a user's gestures with sensing probe assemblies, then controls water or soap supply through a controller. As a result, a user does not need to touch the faucet and can conveniently use the faucet.

DETAILED DESCRIPTION

The present invention will be further described in detail below with reference to the accompanying drawings and specific embodiments.

Figure 1:
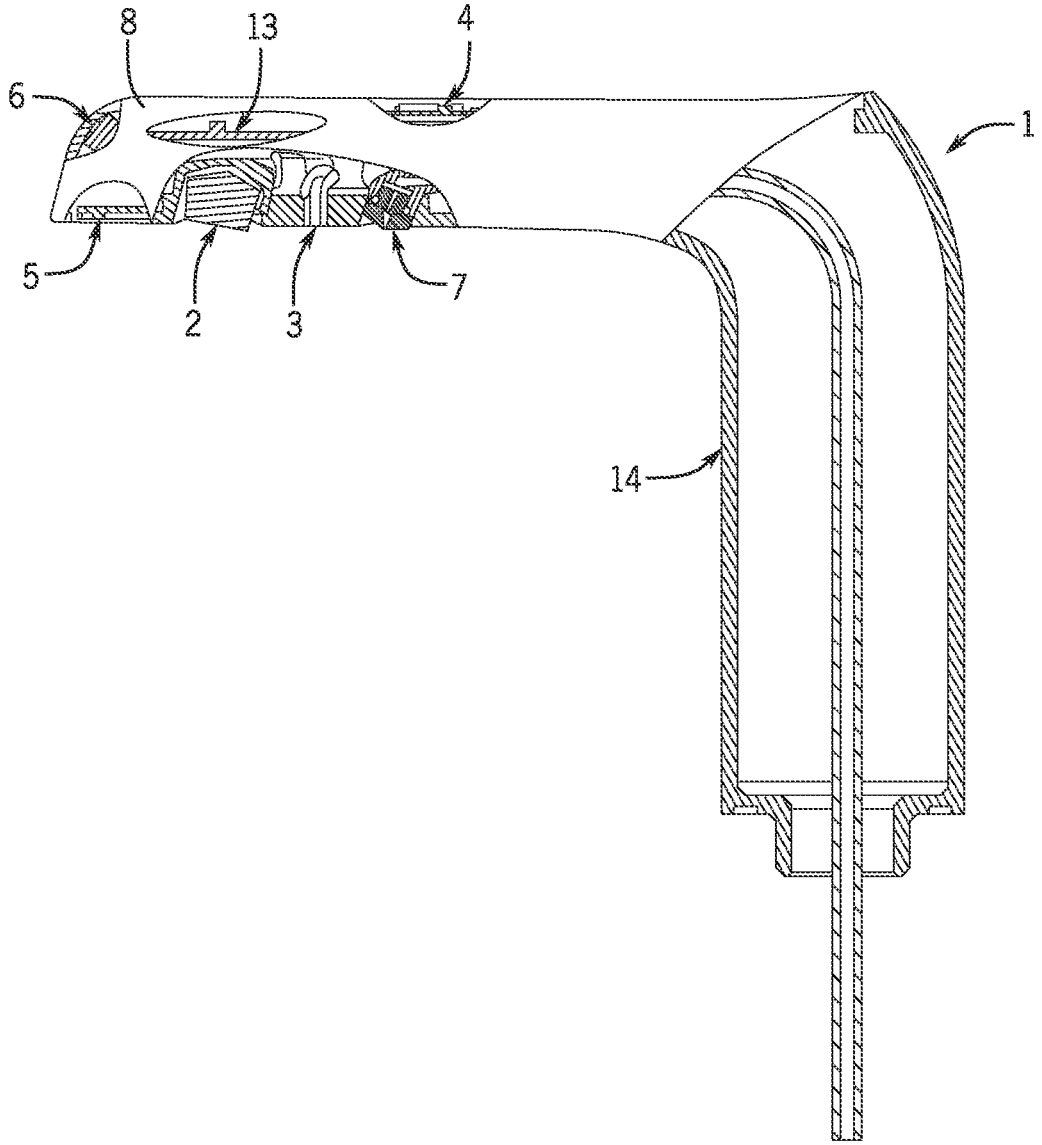
FIG. 1 is a schematic structural diagram of a multifunctional faucet, according to the present invention.
Figure 2:
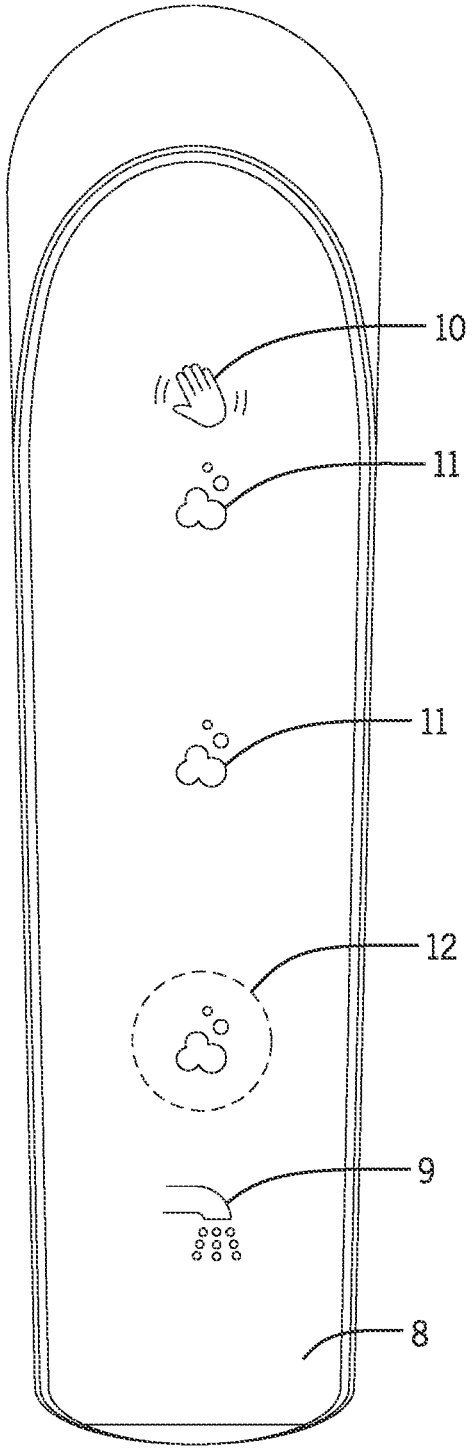
FIG. 2 is a schematic diagram of a cover of the multifunctional faucet, according to the present invention.
Figure 3:
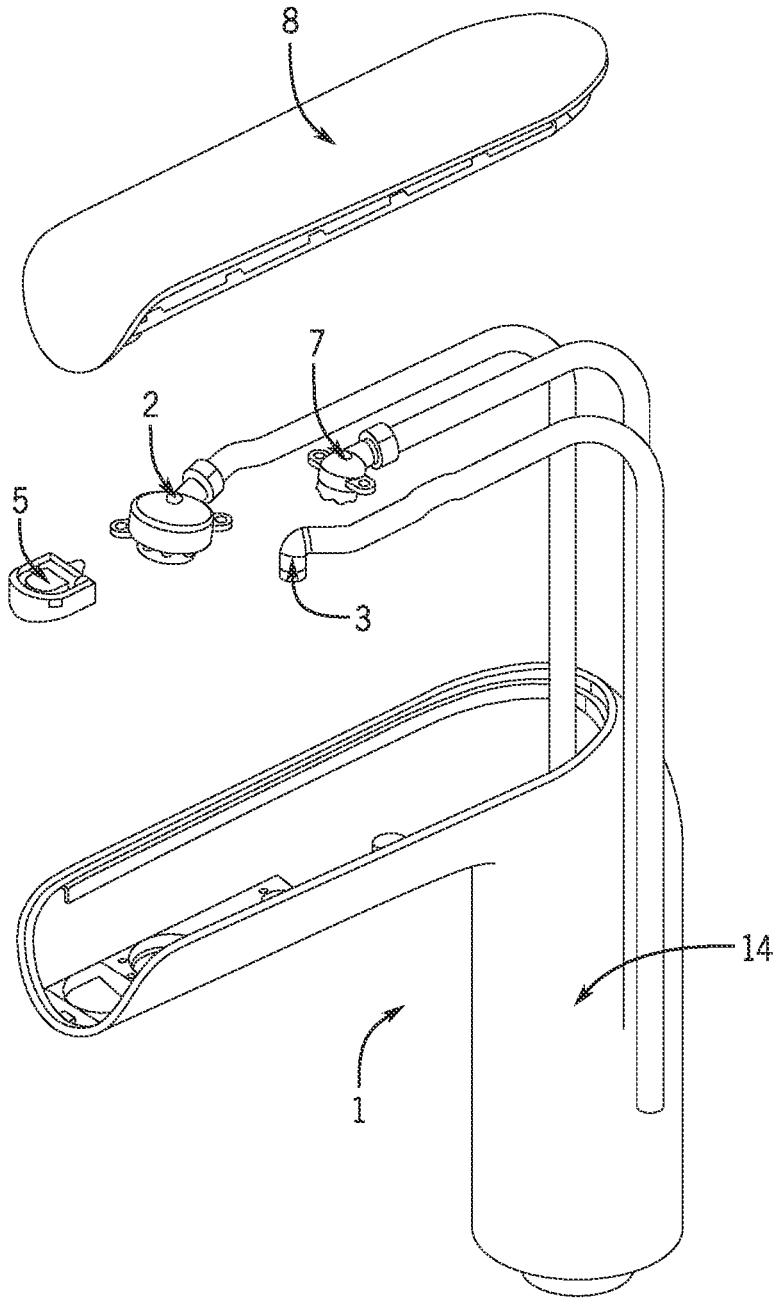
FIG. 3 is an exploded view of the multifunctional faucet, according to the present invention.

FIGS. 1-3 illustrate a structure of the multifunctional faucet according to the present invention. The illustrated faucet includes a faucet housing 1 with a water supply assembly, a soap supply assembly, a first sensing probe assembly 4, a second sensing probe assembly 5, and a controller (not shown) provided in the faucet housing 1. The sensing region of the first sensing probe assembly 4 is an upper portion of the faucet housing 1, and the sensing region of the second sensing probe assembly 5 is a lower portion of the faucet housing 1. An output terminal of the first sensing probe assembly 4 and an output terminal of the second sensing probe assembly 5 are respectively in communicative connection with an input terminal of the controller. An output terminal of the controller is in communicative connection with a control terminal of the water supply assembly and a control terminal of the soap supply assembly, such that the controller controls the water supply assembly to start water supply or stop water supply according to a sensing signal from the first sensing probe assembly or the second sensing probe assembly, and the controller controls the soap supply assembly to start soap supply or stop soap supply according to a sensing signal from the first sensing probe assembly or the second sensing probe assembly.

For example, the first sensing probe assembly 4 and the second sensing probe assembly 5 can be non-contact sensing probe assemblies, including but not limited to infrared sensing, near-field sensing, electromagnetic sensing, etc. The first sensing probe assembly 4 senses gestures of a user above the faucet housing, and the second sensing probe assembly 5 senses gestures of a user below the faucet housing. When the first sensing probe assembly 4 or the second sensing probe assembly 5 senses a user gesture, a generated sensing signal will be sent to the controller. According to a corresponding sensing signal, the controller controls the water supply assembly to start water supply from a bubbler 2 or stop water supply and controls the soap supply assembly to start soap supply from a soap dispenser 3 or stop soap supply according to a corresponding sensing signal.

The faucet senses a user's gestures with sensing probe assemblies, then controls water or soap supply through a controller. As a result, a user does not need to touch the faucet and can conveniently use the faucet.

In at least one embodiment, the multifunctional faucet includes a third sensing probe assembly 6 disposed in the faucet housing 1, where the sensing region of the third sensing probe assembly 6 is the front of the faucet housing 1. An output terminal of the third sensing probe assembly 6 is in communicative connection with a trigger terminal of the controller, and the controller is triggered and activated when the third sensing probe assembly detects a sensing signal. The third sensing probe assembly, if included, is configured to sense whether a user approaches the faucet housing and activates the control from the standby state in response to detecting/sensing such a user, thereby achieving energy saving. For example, the third sensing probe assembly can be a non-contact sensing probe assembly, including but not limited to infrared sensing, near-field sensing, electromagnetic sensing, etc.

In at least one embodiment, the multifunctional faucet includes an electrolyte assembly disposed in the faucet housing 1, where the output terminal of the controller is in communicative connection with the electrolyte assembly, and the controller controls the electrolyte assembly to start electrolyte supply or stop electrolyte supply. The electrolyte assembly, if included, is configured to provide for regular sterilization of a basin through an electrolyte nozzle 7.

In at least one embodiment, the faucet housing 1 includes a base 14 and a cover assembly 8 in coordination with the base, where the base 14 and the cover assembly 8 form an accommodating chamber. The water supply assembly, the soap supply assembly, and the second sensing probe assembly 5 are accommodated in the accommodating chamber. The first sensing probe assembly 4 is accommodated in the cover assembly 8. A water supply indicator 9, a hand-waving prompt indicator 10, a wait-for-soap indicator 11, and a soap supply indicator 12 are further provided in the cover assembly 8, and the output terminal of the controller is in communicative connection (e.g., electrical communication) with the water supply indicator 9, the hand-waving prompt indicator 10, the wait-for-soap indicator 11, and the soap supply indicator 12.

The cover assembly, if included, is provided with the water supply indicator 9, the hand-waving prompt indicator 10, the wait-for-soap indicator 11, and the soap supply indicator 12 therein. An indicator control panel 13 displays relevant prompt according to a control by the controller, so as to provide an instruction for a user's water taking action and soap taking action, where the third sensing probe assembly 6 may also be installed in the cover assembly 8.

A process flow (e.g., flow chart) of a control method for the above-described multifunctional faucet according to the present invention can include the following three aspects.

First, when the controller is in a wake state, if a sensing signal is received from the second sensing probe assembly, the controller enters a water supply state to control the water supply assembly to start water supply; if a sensing signal is received from the first sensing probe assembly, the controller enters a soap supply state to control the soap supply assembly to start soap supply within a preset soap supply period and control the soap supply assembly to stop soap supply after the preset soap supply period.

Second, when the controller is in the water supply state, if a sensing signal is received from the first sensing probe assembly, the controller enters the soap supply state to control the soap supply assembly to start soap supply within a preset soap supply period and control the soap supply assembly to stop soap supply after the preset soap supply period. When the controller is in the water supply state, if no sensing signal is received from the first sensing probe assembly and no sensing signal is received from the second sensing probe assembly, the controller enters the wake state.

Third, when the controller is in the soap supply state, and after the preset soap supply period, if a sensing signal is received from the second sensing probe assembly, the controller enters the water supply state to control the water supply assembly to start water supply, and if no sensing signal is received from the second sensing probe assembly, the controller enters the wake state to control the water supply assembly to stop water supply.

Figure 4:
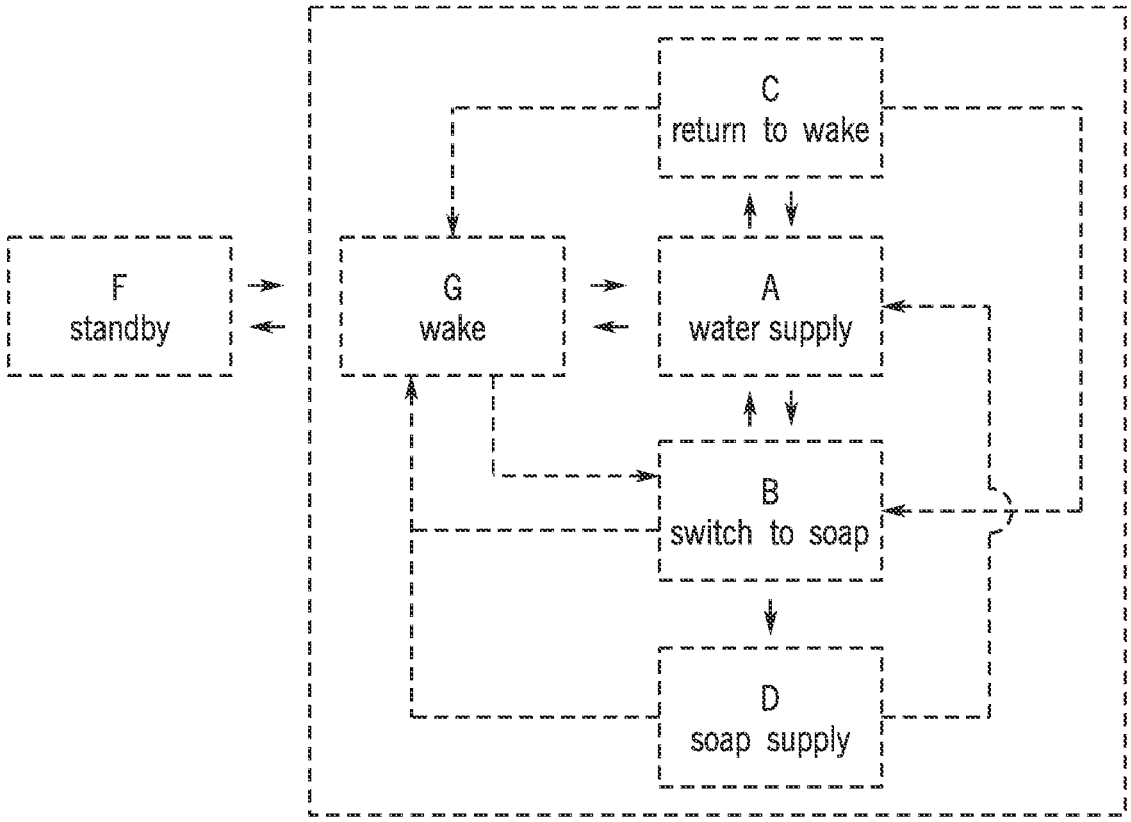
FIG. 4 is a schematic diagram of state switch of a controller, according to the present invention.

FIG. 4 is a schematic diagram of a state switch of the controller according to the present invention. Specifically, the states include the wake state G, the water supply state A, and the soap supply state D. The controller switches states according to a sensing signal from the first sensing probe assembly 4 or a sensing signal from the second sensing probe assembly 5. In the water supply state, the controller controls the water supply assembly to supply water, and in the soap supply state, the controller controls the soap supply assembly to supply soap.

In at least one embodiment, the step of, if a sensing signal is received from the first sensing probe assembly 4, the controller entering the soap supply state specifically involves the controller entering a switch-to-soap state in response to a sensing signal being received from the first sensing probe assembly 4. When the controller is in the switch-to-soap state, if a sensing signal is continuously received from the first sensing probe assembly 4 within a preset confirmation period, the controller enters the soap supply state, and if no sensing signal is continuously received from the first sensing probe assembly 4 within the preset confirmation period, the controller enters the wake state.

Since a soap will be supplied for a preset period during the soap supply, the switch-to-soap state B can be added to the present embodiment, and a user's intention to switch to soap is confirmed by continuously receiving a sensing signal from the first sensing probe assembly 4, thereby avoiding false triggering.

In at least one embodiment, the faucet housing 1 includes a base 14 and a cover assembly 8 in coordination with the base, where the base 14 and the cover assembly 8 form an accommodating chamber. The water supply assembly, the soap supply assembly, and the second sensing probe assembly 5 are accommodated in the accommodating chamber. The first sensing probe assembly 4 is accommodated in the cover assembly 8 along with a water supply indicator 9, a hand-waving prompt indicator 10, a wait-for-soap indicator 11, and a soap supply indicator 12, which are further provided in the cover assembly 8. The output terminal of the controller is in communicative connection with the water supply indicator 9, the hand-waving prompt indicator 10, the wait-for-soap indicator 11, and the soap supply indicator 12. The step of, when the controller is in the water supply state, if no sensing signal is received from the first sensing probe assembly 4 and no sensing signal is received from the second sensing probe assembly 5, the controller entering the wake state specifically includes: when the controller is in the water supply state, if no sensing signal is received from the first sensing probe assembly 4 and no sensing signal is received from the second sensing probe assembly 5, the controller enters a return-to-wake state C and controls the wait-for-soap indicator 10 to display a preset prompt effect, and if the controller is in the return-to-wake state C, no sensing signal is received from the first sensing probe assembly and no sensing signal is received from the second sensing probe assembly continuously within a preset return period, the controller enters the wake state G. The control method can further include: when the controller is in the water supply state, controlling the water supply indicator to display a preset water supplying animation effect; when the controller is in the switch-to-soap state B, controlling the wait-for-soap indicator to display a preset soap switching animation effect; and when the controller is in the soap supply state D, controlling the soap supply indicator to display a preset soap supplying animation effect.

Figure 5:
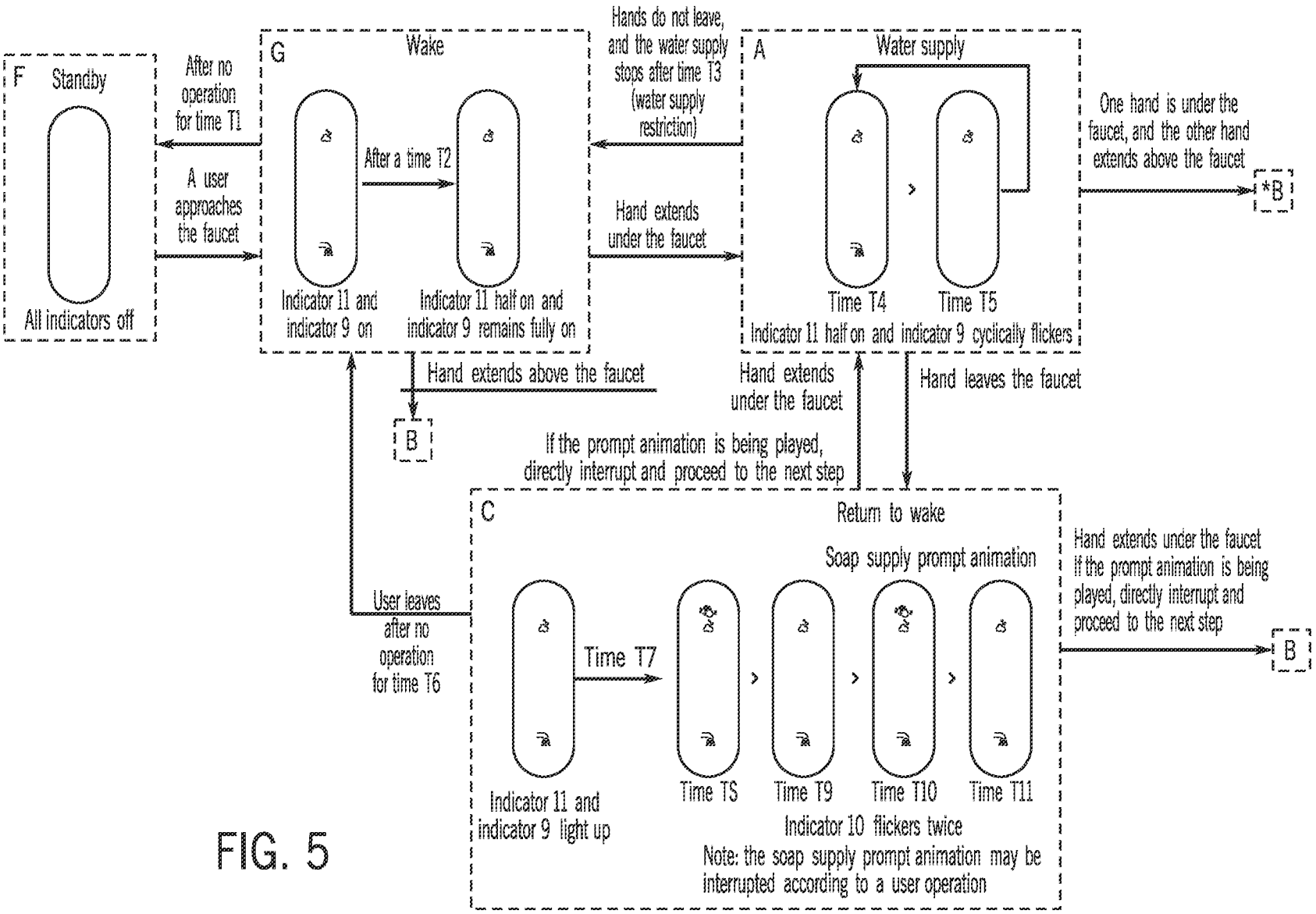
FIG. 5 is a schematic diagram of the controller in the standby state, the wake state, and the water supply state.
Figure 6:
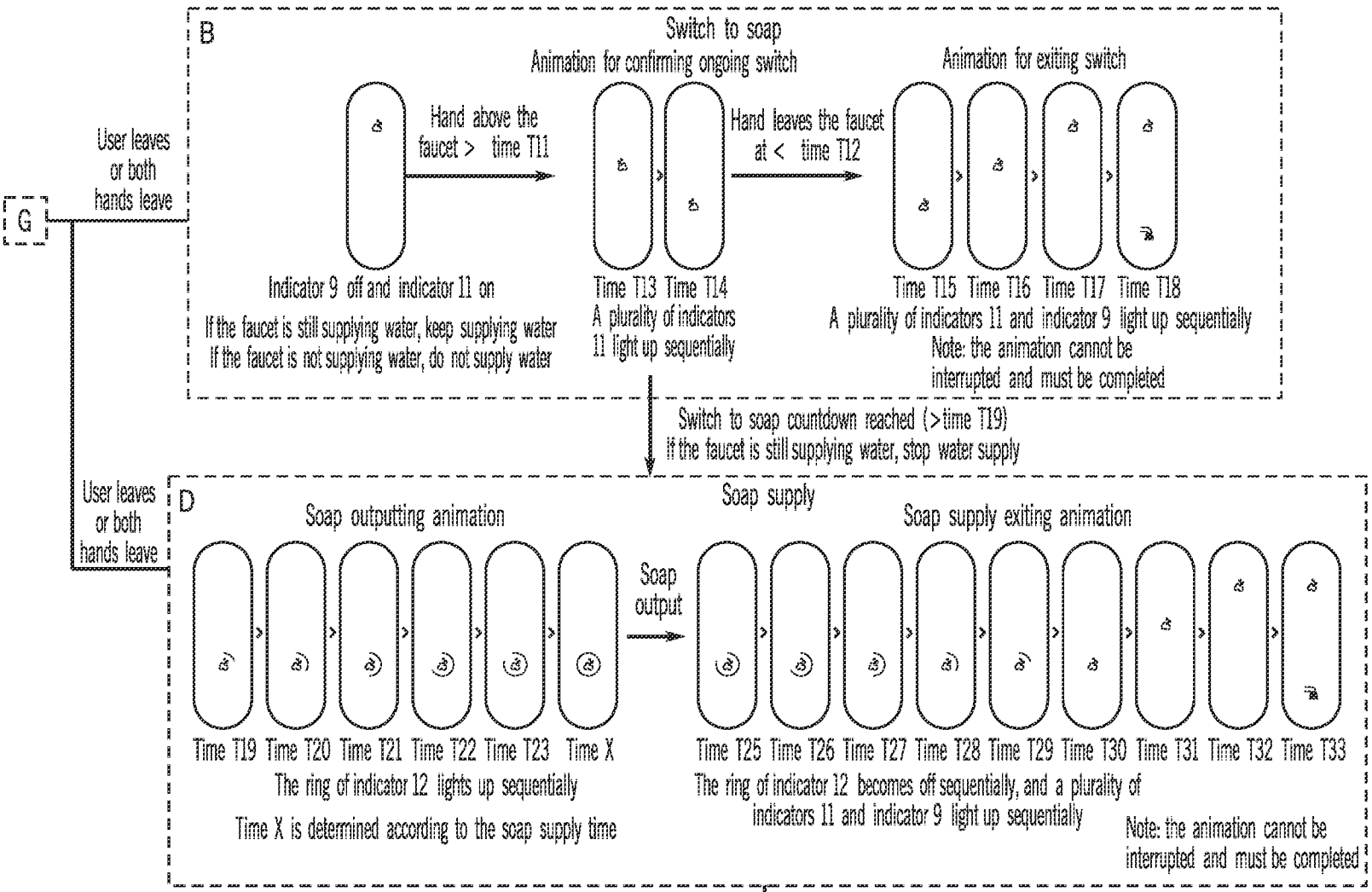
FIG. 6 is a schematic diagram of the controller in the switch to soap state and soap supply state.

FIG. 5 and FIG. 6 are schematic diagrams of prompt effects and animation effects. In the water supply state A, the water supply indicator 9 cyclically flickers to achieve a water supplying animation effect, and meanwhile, the wait-for-soap indicator 11 is semi-bright. In the return-to-wake state C, the hand-waving prompt indicator 10 flickers to achieve a prompt effect. In the switch-to-soap state B, a plurality of wait-for-soap indicators 11 turn on sequentially to display a soap switching animation effect, where the soap switching animation effect includes an animation effect for confirming ongoing switch and an animation effect for exiting switch. In the soap supply state D, the periphery of the soap supply indicator 12 lights up sequentially to achieve a soap supplying animation effect.

In at least one embodiment, the multifunctional faucet includes a third sensing probe assembly 6 disposed in the faucet housing 1, where the sensing region of the third sensing probe assembly 6 is the front of the faucet housing 1. An output terminal of the third sensing probe assembly 6 is in communicative connection with a trigger terminal of the controller, and the control method further includes triggering the controller to enter the wake state G when the third sensing probe assembly 6 detects a sensing signal, and when the controller is in the wake state, if no sensing signal is received from the first sensing probe assembly 4 and no sensing signal is received from the second sensing probe assembly 5 within a preset standby detection period, the controller enters a standby state F.

As shown in FIG. 4, the illustrated embodiment includes the standby state F. When no sensing signal is received within the preset standby detection period, e.g., 10 s, the controller enters the standby state F, and when the third sensing probe assembly 6 detects a sensing signal, the controller is triggered to enter the wake state G.

In at least one embodiment, the multifunctional faucet includes an electrolyte assembly disposed in the faucet housing 1, where the output terminal of the controller is in communicative connection with the electrolyte assembly, the controller controls the electrolyte assembly to start electrolyte supply or stop electrolyte supply, and the control method further includes controlling the electrolyte assembly to start electrolyte supply after every preset cleaning interval, and controlling the electrolyte assembly to stop electrolyte supply after a preset electrolyte supply period.

After every cleaning interval, the electrolyte assembly in the embodiment(s) supplies an electrolyte as controlled by the controller to sterilize the basin.

In at least one embodiment, the step of controlling the electrolyte assembly to start electrolyte supply after every preset cleaning interval specifically includes: after every preset cleaning interval, if the controller is in the standby state, controlling the electrolyte assembly to start electrolyte supply, and if the controller is in a state other than the standby state, controlling the electrolyte assembly to suspend electrolyte supply.

In the embodiment(s), after every preset cleaning interval, a timer triggers the controller to detect its state. If the controller is in the standby state, the electrolyte assembly starts to supply the electrolyte. If the controller is in another state (e.g., the wake state, the water supply state, the switch-to-soap state, and the soap supply state), the electrolyte assembly suspends electrolyte supply, and when the controller enters the standby state again, the electrolyte assembly resumes electrolyte supply.

The embodiments described above only represent several implementation manners of the present invention, and the embodiments are described in a relatively specific and detailed manner, which may not be construed as limitations to the scope of the present invention. It should be noted that a person skilled in the art may further make several variations and improvements without departing from the concept of the present invention, and all the variations and improvements shall fall within the scope of the present invention. Therefore, the scope of the present invention shall be subject to the appended claims.

What is claimed is:

1. A faucet assembly, comprising:

a housing;

a water supply assembly disposed in the housing;

a first sensing probe disposed in the housing and configured to control activation of the water supply assembly;

a second sensing probe disposed in the housing and configured to sense whether a user approaches the housing; and a controller disposed in the housing, the controller in communicative connection with the water supply assembly, the first sensing probe, and the second sensing probe;

wherein the second sensing probe is configured to activate the controller from a standby state to a wake state in response to detecting the user, and wherein in the wake state the controller is configured to control the water supply assembly based on a signal from the first sensing probe.

2. The faucet assembly of claim 1, further comprising a display indicator, wherein activation of the controller to the wake state activates the display indicator.

3. The faucet assembly of claim 2, further comprising an electrolyte assembly disposed in the housing and communicably coupled to the controller, and wherein the controller is configured to control the electrolyte assembly in the standby state to start an electrolyte supply and to stop the electrolyte supply after an electrolyte supply period.

4. The faucet assembly of claim 1, wherein a sensing region of the second sensing probe is a front of the housing.

5. The faucet assembly of claim 1, further comprising an electrolyte assembly disposed in the housing and communicably coupled to the controller, and wherein the controller is configured to control the electrolyte assembly to provide regular sterilization of a basin.

6. The faucet assembly of claim 1, wherein that the housing comprises a base and a cover assembly that together form an accommodating chamber, wherein the water supply assembly and the first sensing probe are disposed in the accommodating chamber, and wherein the second sensing probe is disposed in the cover assembly.

7. The faucet assembly of claim 6, wherein at least one of a water supply indicator or a hand-waving prompt indicator are provided in the cover assembly, and wherein the controller is in communicative connection with the at least one of the water supply indicator or the hand-waving prompt indicator.

8. The faucet assembly of claim 1, wherein the first sensing probe is in communication connection with an input terminal of the controller, the second sensing probe is in communicative connection with a trigger terminal of the controller, and the water supply assembly is in communitive connection with an output terminal of the controller.

9. The faucet assembly of claim 1, further comprising:

a soap supply assembly disposed in the housing; and a third sensing probe disposed in the housing and in communicative connection with the controller, the third sensing probe configured to control activation of the soap supply assembly.

10. A faucet assembly, comprising:

a housing;

a soap supply assembly disposed in the housing;

a first sensing probe disposed in the housing and configured to control activation of the soap supply assembly;

a second sensing probe disposed in the housing and configured to sense whether a user approaches the housing; and a controller disposed in the housing, the controller in communicative connection with the soap supply assembly, the first sensing probe, and the second sensing probe; wherein the second sensing probe is configured to activate the controller from a standby state to a wake state in response to detecting the user, and wherein in the wake state the controller is configured to control the soap supply assembly based on a signal from the first sensing probe.

11. The faucet assembly of claim 10, further comprising a display indicator, wherein activation of the controller to the wake state activates the display indicator.

12. The faucet assembly of claim 11, further comprising an electrolyte assembly disposed in the housing and communicably coupled to the controller, and wherein the controller is configured to control the electrolyte assembly in the standby state to start an electrolyte supply and to stop the electrolyte supply after an electrolyte supply period.

13. The faucet assembly of claim 10, wherein a sensing region of the second sensing probe is a front of the housing.

14. The faucet assembly of claim 10, further comprising an electrolyte assembly disposed in the housing and communicably coupled to the controller, and wherein the controller is configured to control the electrolyte assembly to provide regular sterilization of a basin.

15. The faucet assembly of claim 10, wherein that the housing comprises a base and a cover assembly that together form an accommodating chamber, wherein the soap supply assembly and the first sensing probe are disposed in the accommodating chamber, and wherein the second sensing probe is disposed in the cover assembly.

16. The faucet assembly of claim 15, wherein at least one of a wait-for-soap indicator, a soap supply indicator, or a hand-waving prompt indicator are further provided in the cover assembly, and wherein the controller is in communicative connection with the at least one of the wait-for-soap indicator, the soap supply indicator, or the hand-waving prompt indicator.

17. A control method for a faucet assembly, comprising:

triggering a controller of the faucet assembly to enter a wake state from a standby state in response to receiving a first sensing signal from a first sensing probe of the faucet assembly;

activating, by the controller, a water supply assembly to start a water supply in response to receiving a second sensing signal from a second sensing probe of the faucet assembly;

deactivating, by the controller, the water supply assembly to stop the water supply in response to the absence of the second sensing signal; and triggering the controller to enter the standby state from the wake state in response to the absence of the second sensing signal within a detection period.

18. The control method of claim 17, wherein triggering the controller to enter the wake state from the standby state comprises activating, by the controller, at least one of a water supply indicator or a wait for soap indicator.

19. The control method of claim 17, further comprising:

activating, by the controller, an electrolyte assembly of the faucet assembly to start an electrolyte supply after a preset cleaning interval, and deactivating, by the controller, the electrolyte assembly to stop the electrolyte supply after a preset electrolyte supply period.

20. The control method of claim 19, wherein activating the electrolyte assembly to start the electrolyte supply after the preset cleaning interval comprises:

activating, by the controller, the electrolyte assembly to start the electrolyte supply in response to the controller being in the standby state; and deactivating, by the controller, the electrolyte assembly to suspend the electrolyte supply if the controller is in a state other than the standby state.

* * * * *